US008640903B2

(12) United States Patent
Yu et al.

(10) Patent No.: US 8,640,903 B2
(45) Date of Patent: Feb. 4, 2014

(54) OIL TANK FLOATING ROOF DEVICE

(75) Inventors: Ming-Tsang Yu, New Taipei (TW); Wen-Pin Pen, New Taipei (TW); Chin-Fa Su, New Taipei (TW)

(73) Assignees: Ming-Tsang Yu, New Taipei (TW); Wen-Pin Pen, New Taipei (TW)

( * ) Notice: Subject to any disclaimer, the term of this patent is extended or adjusted under 35 U.S.C. 154(b) by 0 days.

(21) Appl. No.: 13/399,218

(22) Filed: Feb. 17, 2012

(65) Prior Publication Data

US 2012/0211491 A1 Aug. 23, 2012

(30) Foreign Application Priority Data

Feb. 17, 2011 (TW) ..... 100202881 A

(51) Int. Cl.
*B65D 88/34* (2006.01)

(52) U.S. Cl.
USPC ..... 220/216; 220/218; 220/220; 52/223.1

(58) Field of Classification Search
USPC ..... 220/216, 218, 220; 52/223.1
See application file for complete search history.

(56) References Cited

U.S. PATENT DOCUMENTS 3,100,556 A * 8/1963 De Ridder ..... 52/588.1
5,704,509 A * 1/1998 Rosenkrantz ..... 220/216
7,225,942 B2 * 6/2007 Song ..... 220/218

FOREIGN PATENT DOCUMENTS

TW 201008850 3/2010

OTHER PUBLICATIONS

Master Steel Fabrication Ltd., Steel Glossary copyright 2005, http://www.mastersteel.com/glossary.*

* cited by examiner

*Primary Examiner* — J. Gregory Pickett
*Assistant Examiner* — Blaine Neway
(74) *Attorney, Agent, or Firm* — Muncy, Geissler, Olds & Lowe, PLLC

(57) ABSTRACT

An oil tank floating roof device, includes a plurality of connecting bars and a plurality of floating units, which are respectively secured to the plurality of connecting bars by means a plurality of longitudinal and crosswise holding spaces collectively encircling the floating units. A plurality of locking members are fitted on the peripheries of the floating units, and two sides of the connecting bars respectively form at least one joining groove. The joining grooves respectively enable each of the floating units to longitudinally or crosswisely insert therein. The top portions of the connecting bars form at least one pressure resistant reinforcing plate, and the pressure resistant reinforcing plate is fitted with a plurality of locking portions. Bolts are used to respectively correspondingly pass through the locking portions and bolt into the locking members on the longitudinal or crosswise sides of the base of the floating units.

5 Claims, 6 Drawing Sheets

OIL TANK FLOATING ROOF DEVICE

BACKGROUND OF THE INVENTION (a) Field of the Invention

The present invention relates to an oil tank floating roof device, and more particularly to a floating device applied to the liquid surface of oil stored in a tank, using longitudinal or crosswise insertion joint connections to produce stable and pressure resistant joining areas while reducing assembly cost.

(b) Description of the Prior Art

Regarding oil tank structures for oil storage of the prior art, apart from hollow tanks being used for oil storage, moreover, floating roof equipment must also be disposed in the oil tank, the floating roof equipment being used to float and cover the liquid surface of the oil stored in the oil tank, thereby enabling upward or downward displacement of the floating roof equipment along with a rise or fall of the height of the liquid level of the stored oil, and a sealed top surface of the oil tank top is used to reduce emissions form the storage of volatile organic compounds. Republic of China patent No. 201008850 entitled "Fuel Tank Floating Roof Device", discloses a floating roof equipment for oil storage tank typical of the prior art, and such a floating roof equipment forms fixed edge fittings with the casing of floating units. In which each of the floating units forms overlapping locking connections between longitudinal frame bars, crosswise frame bars by means of fixed joined edges. Such a configuration requires that the casing forms fixed edge fittings, resulting in an increase in manufacturing cost of each of the floating units. Moreover, exterior shape must be changed, and thus are not economical for industrial use.

In addition, in the aforementioned patent, the bottom portions of the longitudinal frame bars or crosswise frame bars are fitted with first load bearing portions and second load bearing portions, which only enable the joining areas between each of the floating units to reinforce rising buoyancy or falling buoyancy of the liquid level of the oil stored in the tank, while joining areas at upper sides of the longitudinal frame bars or the crosswise frame bars are put under stress and deform. In the aforementioned patent, there is no deformation to reinforce the structure between the upper sides of the longitudinal frame bars or the crosswise frame bars and the floating units, thereby easily causing deformation damage to the joining areas between the upper sides of the longitudinal frame bars or the crosswise frame bars and the floating units, and thus greatly diminishing the floating function of the floating mechanism.

SUMMARY OF THE INVENTION

The primary objective of the present invention lies in providing an oil tank floating roof device to improve the excessively high construction cost and the shortcomings and problems of deformation damage between the joining areas of commonly known oil tanks and floating units in oil tanks of the prior art.

In order to achieve the aforementioned objectives, the oil tank floating roof device of the present invention comprises a plurality of connecting bars and a plurality of floating units. The floating units are respectively secured to the plurality of connecting bars by means a plurality of longitudinal and crosswise holding spaces collectively encircling the floating units. In which a plurality of locking members are fitted on the peripheries of the floating units, and two sides of the connecting bars respectively form at least one joining groove. The joining grooves respectively enable each of the floating units to longitudinally or crosswisely insert therein. Moreover, the top portions of the connecting bars form at least one pressure resistant reinforcing plate, and the pressure resistant reinforcing plate is fitted with a plurality of locking portions. Bolts are used to respectively correspondingly pass through the locking portions and bolt into the locking members on the longitudinal or crosswise sides of the base of the floating units, thereby enabling longitudinal or crosswise connection between each of the floating units. Moreover, the pressure resistant reinforcing plates are used to reinforce the deformation strength on the upper sides of the joining areas between the floating units, thereby forming a floating roof device of low assembly cost which is provided with stable pressure resistant joining areas between each of the floating units.

The effectiveness of the oil tank floating roof device of the present invention lies in use of the joining grooves of the connecting bars, the reinforcing plates and the locking members on the peripheries of the floating units to mutually form locking connections, thereby providing a low cost simple assembly, as well as securing the upper and lower sides of the joining areas between each of the floating units. Moreover, the present invention prevents the problems of deformation damage resulting from rising or falling buoyancy of the liquid level of the oil stored in the tank, and thus further improves its industrial utility value.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
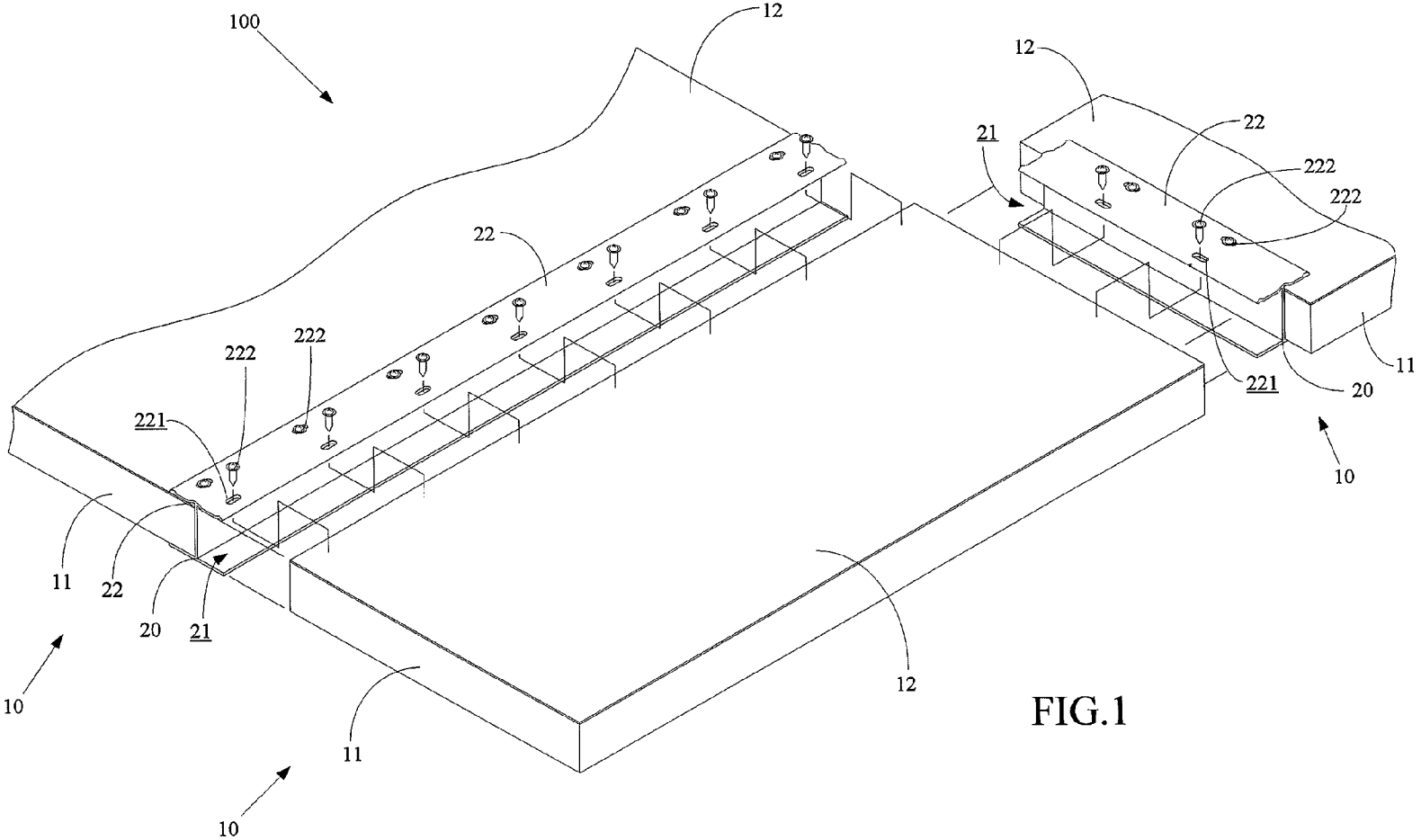
FIG. 1 is an elevational exterior structural view of an oil tank floating roof device of the present invention.
Figure 2:
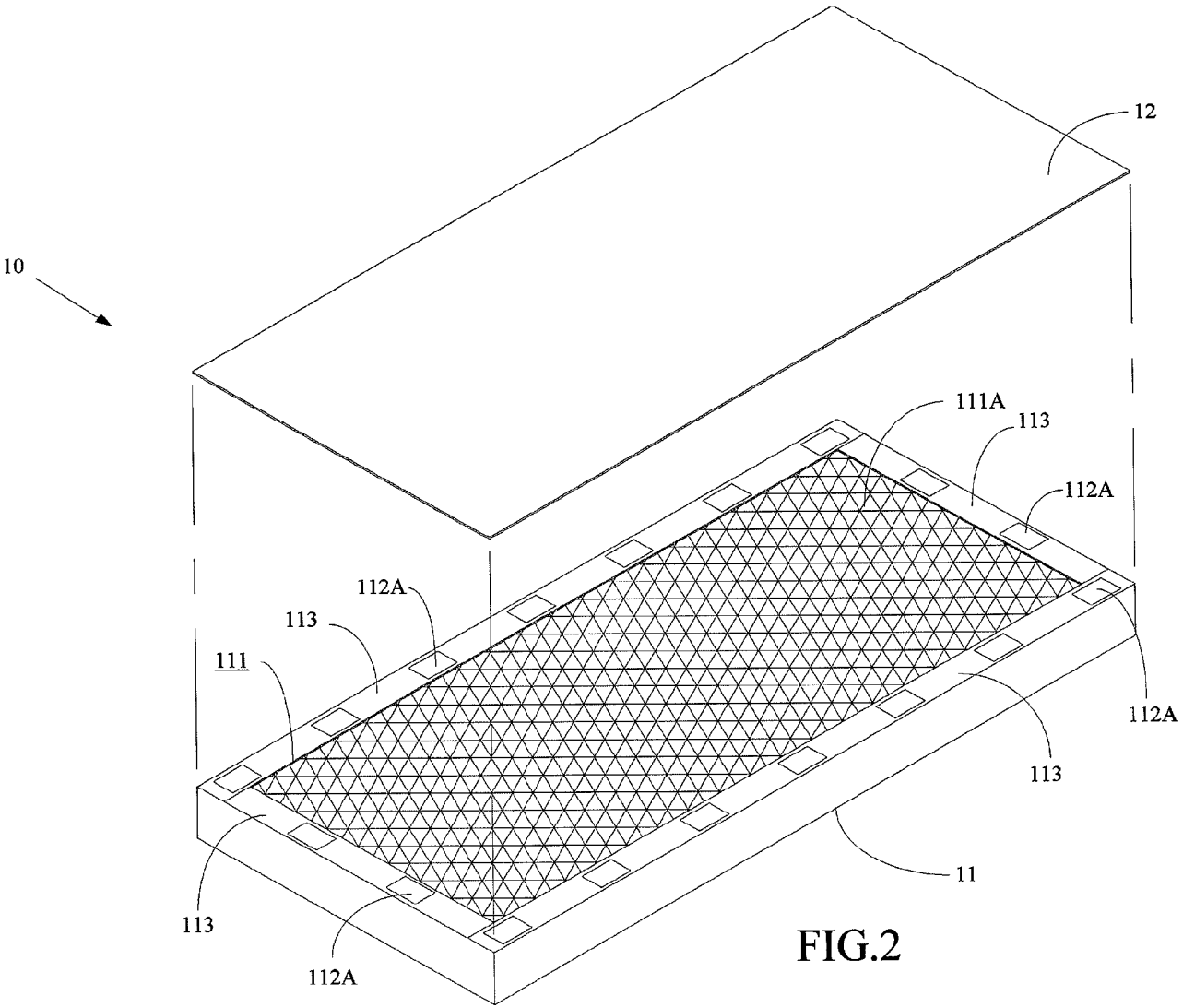
FIG. 2 is an elevational exploded structural view of the oil tank floating roof device of the present invention.
Figure 3:
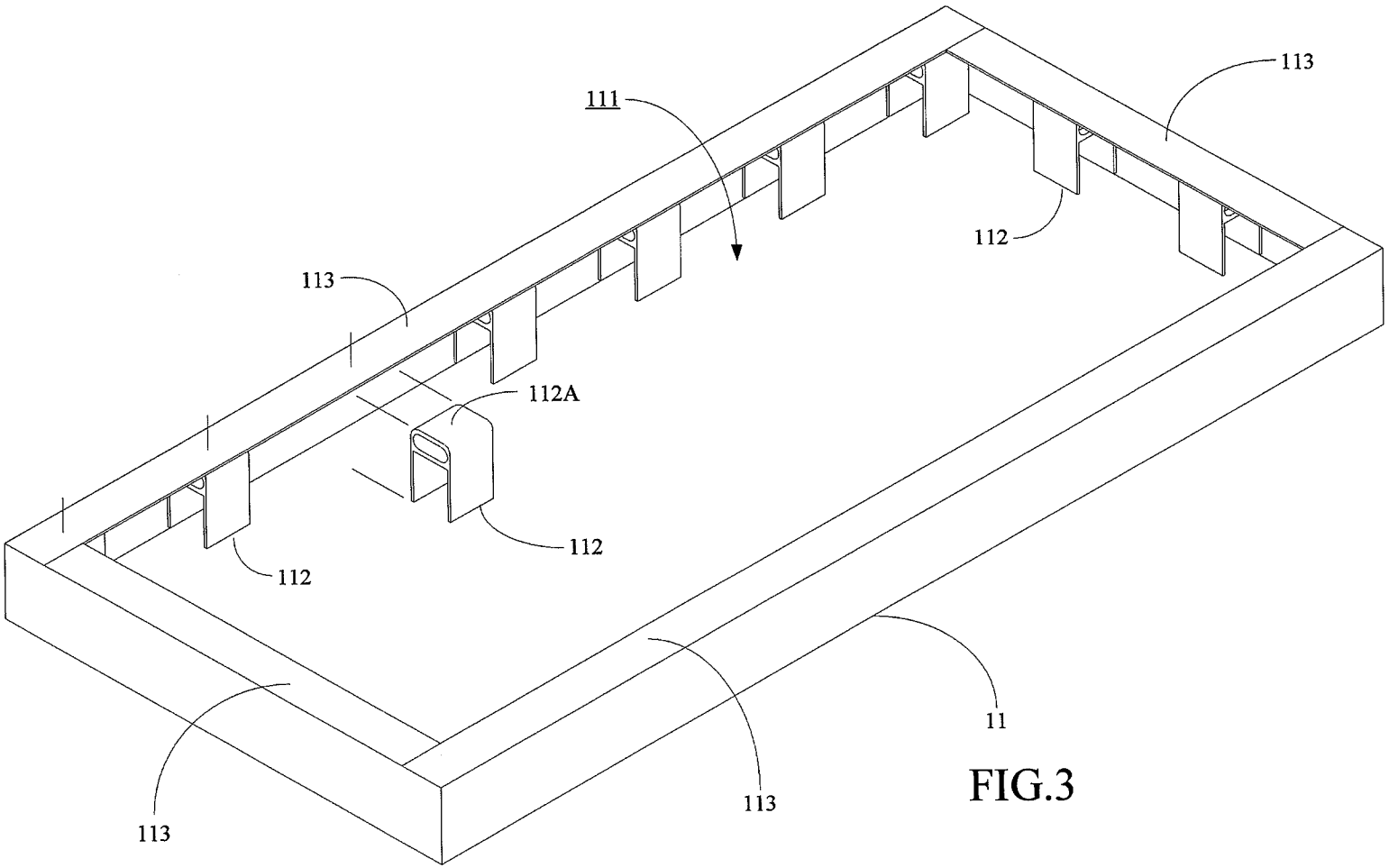
FIG. 3 is a partial exploded structural view of a configuration depicting locking members on a frame used to corresponding join floating units according to the present invention.

Referring to FIG. 1, FIG. 2, FIG. 3 and FIG. 4, which show an oil tank floating roof device 100 of the present invention comprising a plurality of floating units 10, in which each of the floating units 10 comprises a base 11 and an upper cover 12. A base plate 111 is formed within each of the bases 11, and the base plate 111 enables holding a honeycomb lattice 111A. The periphery of the base plate 111 of the base 11 is fitted with a plurality of locking members 112, in which there is no limitation to the shape of the locking members 112. In the present invention, locking members with an inverted squared-off U shape cross section are taken as an exemplary embodiment thereof. The top end of each of the locking members 112 forms a locking surface 112A, and a plurality of frame edges 113 are formed on the periphery of the top surface of the base 11. Each of the frame edges 113 is respectively closely fitted to the locking surface 112A of each of the locking members 11.

The upper cover 12 covers the top surface of the base 11, thereby enabling the periphery of the upper cover 12 to be closely fitted to the frame edges 113 of the periphery of the top surface of the base 11.

Figure 4:
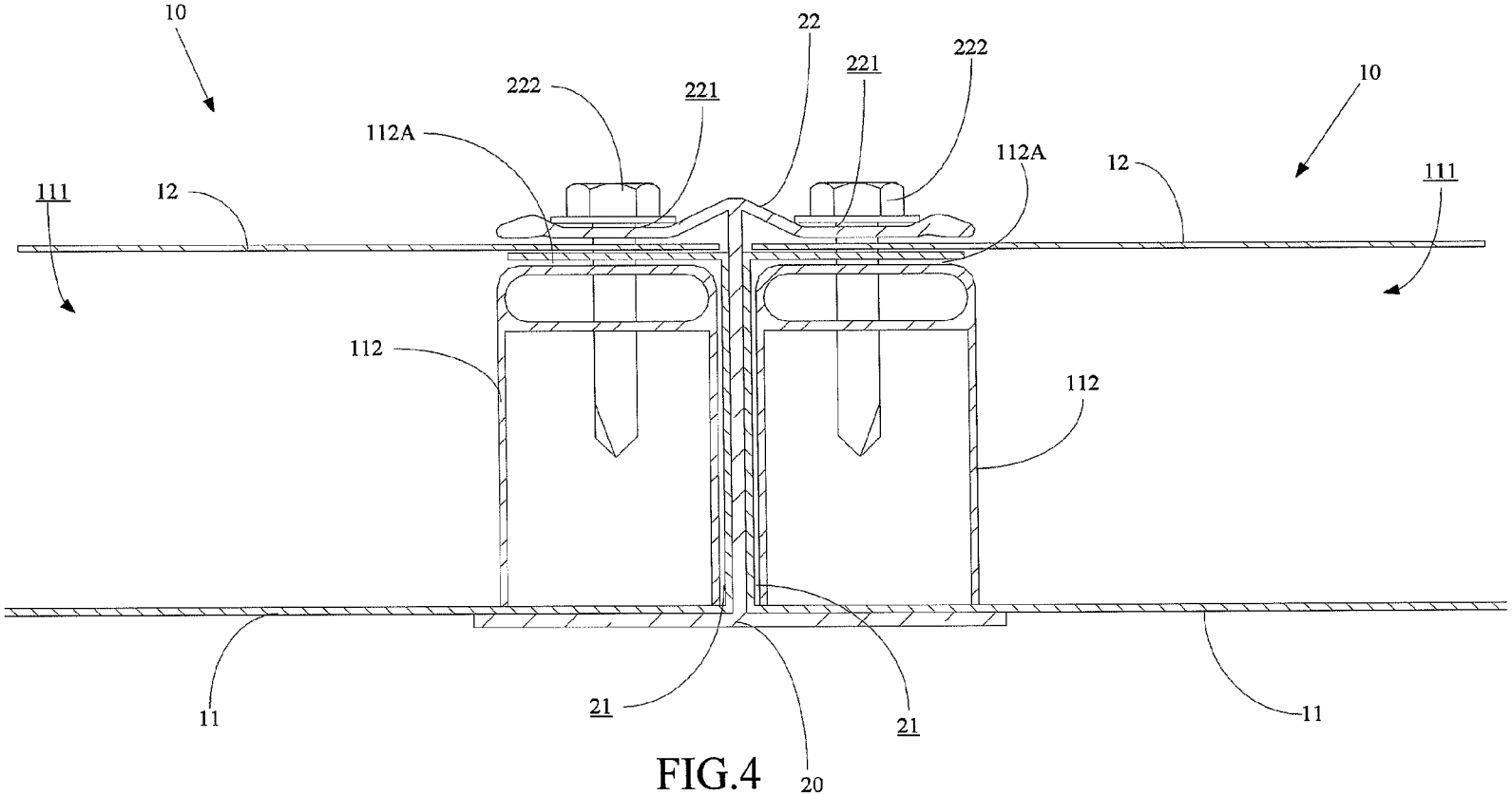
FIG. 4 is a side view depicting the structural connection between the floating units using connecting bars according to the present invention.

A plurality of connecting bars 20, having no limitation on the shape thereof, with connecting bars having a rotated H-shaped cross-section being taken as an exemplary embodiment in the present invention, in which two sides of each of the connecting bars 20 respectively form at least one joining groove 21. The joining grooves 21 respectively enable longitudinal or crosswise side insertion of each of the floating units 10 therein (as depicted in FIG. 1). Moreover, the top portion of each of the connecting bars 20 forms at least one pressure resistant reinforcing plate 22, and each of the pressure resistant reinforcing plates 22 is provided with a plurality of locking portions 221. The locking portions 221 respectively correspond to the peripheries of the upper cover 12 on the longitudinal or crosswise sides of the floating units 10, and bolts 222 are used to respectively correspondingly pass through the locking portions 221 and lock into the locking surfaces 112A of the locking members 112 on the longitudinal or crosswise sides of the base 11 of the floating units 10 (as depicted in FIG. 4), thereby enabling longitudinal or crosswise connection between each of the floating units 10.

Figure 5:
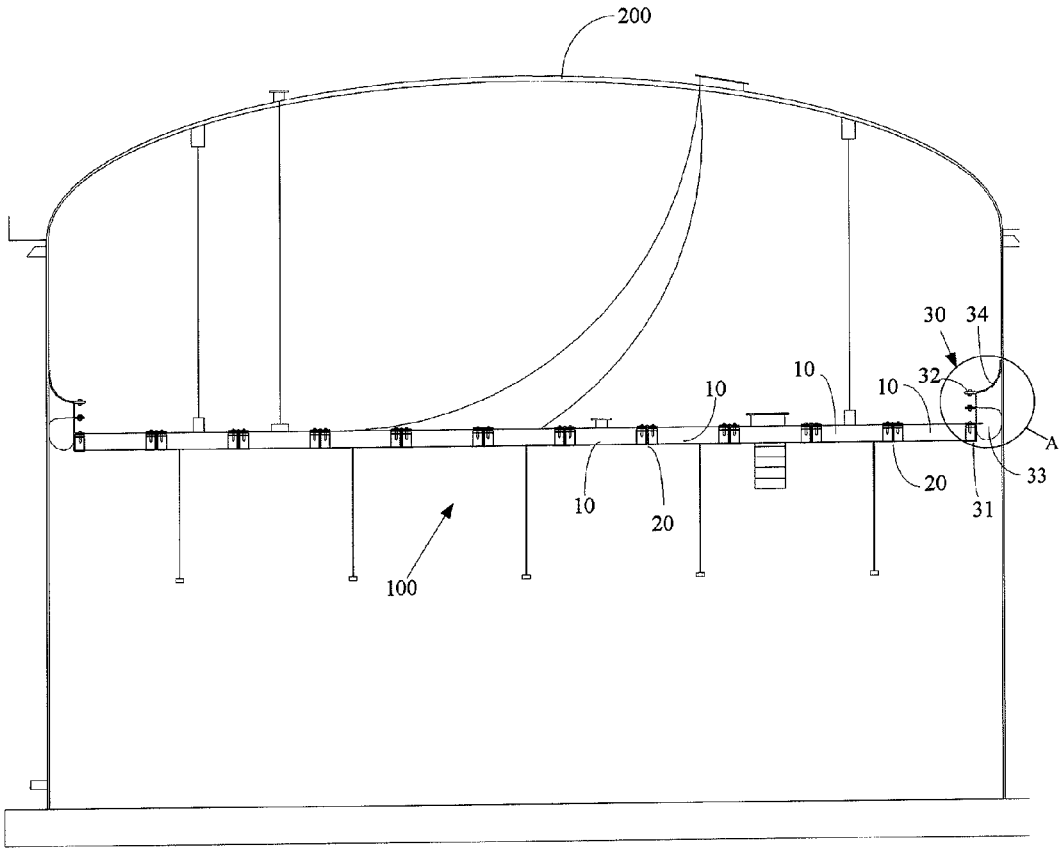
FIG. 5 is a view depicting a preferred embodiment of the oil tank floating roof device according to the present invention.
Figure 5A:
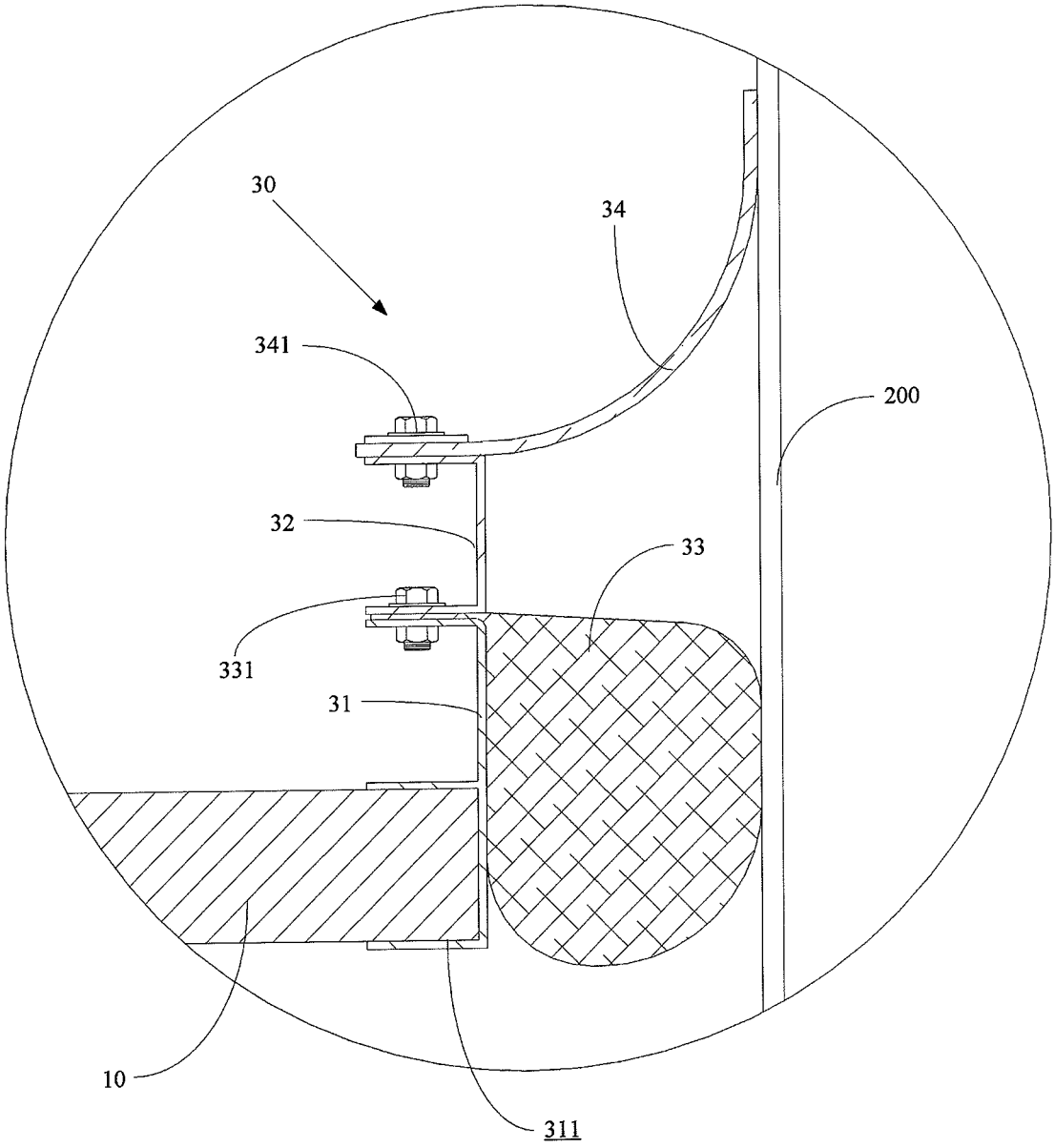
FIG. 5A is an enlarged cutaway view of a sealing ring of FIG. 5.

Referring to FIG. 5 and FIG. 5A at the same time, which show a preferred embodiment of the oil tank floating roof device 100 of the present invention, in which is depicted a configuration of the oil tank floating roof device 100 of the present invention being applied in the inner top portion of an oil tank 200. One time close fitting corresponding locking connections between the locking members 112 of the longitudinal or crosswise sides of the base 11 of the floating units 10 is used to cause direct connection of the base 11, the upper cover 12 and the connecting bars 20 of the floating units 10. Moreover, longitudinal or crosswise connection between each of the floating units 10 is allowed, thereby simplifying the assembling operation between the floating units 10 and the connecting bars 20 and further reducing construction cost thereof. At the same time, apart from the upper and lower sides of the joining groove 21 of each of the connecting bars 20 being able to be used to bear the load of rising and falling buoyancy, moreover, the pressure resistant reinforcing plates 22 at the upper sides of the connecting bars 20 also provide the effectiveness to prevent deformation damage of the connecting areas between each of the floating units 10 caused by the rising or falling buoyancy of the liquid level of the oil in the tank.

In addition, sealing rings 30 are positionally locked between the floating units 10 and the internal periphery of the oil tank 200, thereby surroundingly sealing the configuration. The sealing rings 30 comprise an E-shaped edge seal 31, a C-shaped edge seal 32, a foaming body 33 and a scraping plate 34. At least one insertion groove 311 is formed in the interior of the E-shaped edge seal 31, and the insertion groove 311 enables the furthest side edge of the floating unit 10 to be inserted therein. The bottom surface of the C-shaped edge seal 32 and the top surface of the E-shaped edge seal 31 are correspondingly fastened together. One side of each of the foaming bodies 33 tightly abuts against the wall surface of the oil tank 200, while another side penetrates between the bottom surface of the C-shaped edge seal 32 and the top surface of the E-shaped edge seal 31 and bolted down using a bolt 331, thereby fixedly clamping one side of the foaming body 33 between the bottom surface of the C-shaped edge seal 32 and the top surface of the E-shaped edge seal 31. One end of the scraping plate 341 is bolted to the top surface of the C-shaped edge seal 32 using a bolt 341, and another end of the scraping plate 34 is upwardly curved and abuts against the wall surface of the oil tank 200, thereby preventing oil gas from leaking outside.

It is of course to be understood that the embodiments of the oil tank floating roof device 100 of the present invention depicted in FIGS. 1~FIG. 5A and disclosed described herein are merely illustrative of the principles of the invention and that a wide variety of modifications thereto may be effected by persons skilled in the art without departing from the spirit and scope of the invention as set forth in the following claims.

What is claimed is:

1. An oil tank floating roof device, comprising:

a plurality of floating units, wherein longitudinal and crosswise peripheries of each of the floating units are fitted with a plurality of locking members; and a plurality of connecting bars, wherein at least one joining groove is formed on each of two sides of each of the connecting bars, and each of the joining grooves enable longitudinal or crosswise insertion of each of the floating units therein;

moreover, a top portion of each of the connecting bars forms at least one pressure resistant reinforcing plate, and the pressure resistant reinforcing plate is provided with a plurality of locking portions; the locking portions respectively correspond to the locking members on longitudinal or crosswise sides of the floating units, and bolts are used to respectively penetrate the locking portions and bolt into the locking members, thereby enabling longitudinal or crosswise joining between each of the floating units.

2. The oil tank floating roof device according to claim 1, wherein the floating units comprise:

a base, wherein a base plate is provided in an interior of the base, and the base plate is used for holding a honeycomb lattice; the periphery of the base plate of the base is fitted with the plurality of locking members, and the top portions of the locking members form locking surfaces; a plurality of frame edges are formed on the periphery of the top surface of the base, and each of the frame edges forms a close fitting with the locking surface of each of the locking members; an upper cover, wherein the upper cover covers the top surface of the base, and the periphery of the upper cover is closely fitted to the peripheral frame edges of the top surface of the base.

3. The oil tank floating roof device according to claim 1, wherein the cross section of each of the locking members of the floating units has an inverted squared-off U shape cross section.

4. The oil tank floating roof device according to claim 2, wherein the cross section of each of the locking members of the floating units has an inverted squared-off U shape cross section.

5. The oil tank floating roof device according to claim 1, wherein the cross section of each of the connecting bars of the floating units has a rotated H-shaped cross-section.

* * * * *